US006767084B2

(12) United States Patent
Moriya et al.

(10) Patent No.: US 6,767,084 B2
(45) Date of Patent: Jul. 27, 2004

(54) INK-JET RECORDING HEAD AND INK-JET RECORDING APPARATUS

(75) Inventors: Souichi Moriya, Nagano-ken (JP); Hiroyuki Kamei, Nagano-ken (JP); Masami Murai, Nagano-ken (JP); Kazuhiko Fujimori, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 10/091,443

(22) Filed: Mar. 7, 2002

(65) Prior Publication Data

US 2002/0130930 A1 Sep. 19, 2002

(30) Foreign Application Priority Data

Mar. 8, 2001 (JP) ..... 2001-065410
Feb. 28, 2002 (JP) ..... 2002-054159

(51) Int. Cl.[7] ..... B41J 2/045
(52) U.S. Cl. ..... 347/70; 347/71
(58) Field of Search ..... 347/68, 70, 71, 347/72; 29/890.1

(56) References Cited

U.S. PATENT DOCUMENTS 6,209,994 B1 * 4/2001 Furuhata et al. ..... 347/68
2002/0051040 A1 * 5/2002 Shimada et al. ..... 347/71

FOREIGN PATENT DOCUMENTS

JP 5-286131 11/1993

* cited by examiner

*Primary Examiner*—Judy Nguyen
(74) *Attorney, Agent, or Firm*—Sughrue Mion, PLLC

(57) ABSTRACT

Disclosed are an ink-jet recording head capable of preventing destruction of a piezoelectric element relatively readily and securely and an ink-jet recording apparatus. In the ink-jet recording head including a passage-forming substrate having a pressure generating chamber communicating with a nozzle orifice defined therein and a piezoelectric element provided on a region of the passage-forming substrate via a vibration plate, the region corresponding to the pressure generating chamber, a sealing member defining a piezoelectric element holding portion securing a space not to hinder a movement of the piezoelectric element is provided, the sealing member being joined onto a side of the piezoelectric element of the passage-forming substrate, and at least one sealed portion as a space provided in a member other than the sealing member, communicating with the piezoelectric element holding portion and shielded from outside air is provided, thus volume of the piezoelectric element holding portion is substantially expanded to prevent an increase in humidity of the piezoelectric element.

26 Claims, 8 Drawing Sheets

INK-JET RECORDING HEAD AND INK-JET RECORDING APPARATUS

BACKGROUND OF THE INVENTION

The present invention relates to an ink-jet recording head, in which a part of a pressure generating chamber communicating with a nozzle orifice that ejects ink droplets is constituted of a vibration plate, a piezoelectric element is provided via this vibration plate, and ink droplets are ejected by displacement of the piezoelectric element. Furthermore, the present invention relates to an ink-jet recording apparatus.

With regard to the ink-jet recording head, in which a part of a pressure generating chamber communicating with a nozzle orifice that ejects ink droplets is constituted of a vibration plate, this vibration plate is deformed by the piezoelectric element to pressurize ink in the pressure generating chamber, and ink droplets are ejected from the nozzle orifice, two types of recording heads are put into practical use. One is a recording head using a piezoelectric actuator of a longitudinal vibration mode, which expands and contracts in the axis direction of the piezoelectric element, and the other one is a recording head using a piezoelectric actuator of a flexural vibration mode.

In the former one, a volume of the pressure generating chamber can be changed by abutting an end surface of the piezoelectric element against the vibration plate, and manufacturing of a head suitable to high density printing is enabled. On the contrary, there is required a difficult process in which the piezoelectric element is divided in a comb tooth shape to make it coincide with an array pitch of the nozzle orifices and work whereby divided piezoelectric element is positioned and fixed to the pressure generating chamber. Thus, there is a problem of a complex manufacturing process.

On the other hand, in the latter one, the piezoelectric element can be fabricated and installed on a vibration plate by a relatively simple process in which a green sheet, which is a piezoelectric material, is adhered while fitting a shape thereof to that of the pressure generating chamber and is sintered. However, a certain size of the vibration plate is required due to use of the flexural vibration, thus there is a problem that a high density array of the piezoelectric elements is difficult.

Meanwhile, in order to solve such a disadvantage of the latter recording head, as disclosed in Japanese Patent Laid-Open (kokai)No.5-286131, a recording head is proposed, in which an even piezoelectric material layer is formed over the entire surface of a vibration plate by a deposition technology, the piezoelectric material layer is divided into a shape corresponding to the pressure generating chamber by a lithography method, and the piezoelectric element is formed so as to be independent of the others for each pressure generating chamber.

In the ink-jet recording head as described above, there is a problem that the piezoelectric element is broken due to moisture and the like in the atmosphere. In order to solve this problem, a structure is proposed, in which the piezoelectric element is sealed in a specified space to be shielded from the atmosphere, and an inert fluid is enclosed in the space to prevent destruction of the piezoelectric element.

SUMMARY OF THE INVENTION

However, such a process where the piezoelectric element is sealed in the specified space and the inert fluid is filled in the space has problems that it is relatively difficult and that a manufacturing cost thereof is increased.

Moreover, though the destruction of the piezoelectric element can be prevented also by providing humidity absorbent in the space where the piezoelectric element is sealed in place of the inert fluid, there is a problem that a manufacturing process thereof is difficult similarly to the case of the inert fluid. Furthermore, there is also a problem that a function of the humidity absorbent is lowered with the elapse of time to cause a malfunction thereof, In consideration of circumstances as described above, the object of the present invention is to provide an ink-jet recording head capable of preventing the destruction of the piezoelectric element relatively readily and securely, and to provide an ink-jet recording apparatus.

A first aspect of the present invention for solving the above-described problems is an ink-jet recording head including a passage-forming substrate having a pressure generating chamber communicating with a nozzle orifice defined therein and a piezoelectric element provided on a region of the passage-forming substrate via a vibration plate, the region corresponding to the pressure generating chamber, comprising: a sealing member defining a piezoelectric element holding portion securing a space not to hinder a movement of the piezoelectric element, the sealing member being joined onto a side of the piezoelectric element of the passage-forming substrate; and at least one sealed portion as a space provided in a member other than the sealing member, communicating with the piezoelectric element holding portion and shielded from outside air.

In the first aspect, since a volume of the space sealing the piezoelectric element is made substantially large, a permissible level for a variation factor during a manufacturing process is increased, so that the manufacturing process can be simplified and the yield is improved.

A second aspect of the present invention is the ink-jet recording head according to the first aspect, wherein an increase in humidity in the piezoelectric element holding portion is prevented by the sealed portion.

In the second aspect, the destruction of the piezoelectric element, which is caused by the moisture, can be prevented for a long period of time.

A third aspect of the present invention is the ink-jet recording head according to any one of the first and second aspects, wherein humidity absorbent is provided in the sealed portion.

In the third aspect, the inside of the piezoelectric element holding portion is maintained at low humidity by the humidity absorbent, and the malfunction of the piezoelectric element, which is caused by the moisture and the like in the atmosphere, is prevented.

A fourth aspect of the present invention is the ink-jet recording head according to the third aspect, wherein the humidity absorbent is exchangeable.

In the fourth aspect, the humidity absorbent is exchanged at specified timing, thus the inside of the piezoelectric element holding portion can be always maintained at low humidity.

A fifth aspect of the present invention is the ink-jet recording head according to any one of the first to fourth aspects, wherein a dry fluid is filled in the sealed portion.

In the fifth aspect, the inside of the piezoelectric element holding portion is maintained securely at low humidity, and the malfunction of the piezoelectric element, which is caused by the moisture in the atmosphere, is prevented.

A sixth aspect of the present invention is the ink-jet recording head according to the fifth aspect, wherein the dry fluid is an inert fluid.

In the sixth aspect, since the piezoelectric element is maintained in the inert fluid, the malfunction of the piezoelectric element, which is caused by a change of an external environment, is prevented.

A seventh aspect of the present invention is the ink-jet recording head according to any one of the first to sixth aspects, wherein a pressure in the piezoelectric element holding portion is set equal to the atmospheric pressure or higher.

In the seventh aspect, the pressure in the piezoelectric element holding portion is always made larger than the atmospheric pressure, and the moisture can be prevented from invading the inside of the piezoelectric element holding portion from an adhesive layer or the like joining the passage-forming substrate and the sealing member to each other.

An eighth aspect of the present invention is the ink-jet recording head according to the seventh aspect, wherein pressure adjusting means for adjusting the pressure in the sealed portion to be approximately equal to the atmospheric pressure is provided in a wall defining the sealed portion.

In the eighth aspect, since the pressure in the piezoelectric element holding portion is always made approximately equal to the atmospheric pressure, a stress does not occur in the vibration plate even if the atmospheric pressure is changed, and an ink ejection characteristic can always be well maintained.

A ninth aspect of the present invention is the ink-jet recording head according to the seventh aspect, wherein the dry fluid is compressed and filled in the sealed portion.

In the ninth aspect, the pressure in the piezoelectric element holding portion is always made larger than the atmospheric pressure, and the moisture can be prevented from invading the inside of the piezoelectric element holding portion from the adhesive layer or the like joining the passage-forming substrate and the sealing member to each other.

A tenth aspect of the present invention is the ink-jet recording head according to the ninth aspect, wherein the dry fluid is supplied from the sealed portion into the piezoelectric element holding portion to maintain the pressure in the piezoelectric element holding portion approximately constant.

In the tenth aspect, the pressure in the piezoelectric element holding portion is maintained approximately constant for a long period of time.

An eleventh aspect of the present invention is the ink-jet recording head according to any one of the first to tenth aspects, wherein a drive circuit for driving the piezoelectric element is provided on the sealing member, and the drive circuit is sealed by the sealed portion.

In the eleventh aspect, it is not necessary to mold the drive circuit with resin or the like, and the manufacturing process can be simplified.

A twelfth aspect of the present invention is the ink-jet recording head according to any one of the first to eleventh aspects, wherein the passage-forming substrate consists of a single crystal silicon substrate, the pressure generating chamber is formed by anisotropic etching, and respective layers of the piezoelectric element are formed by deposition and lithography methods.

In the twelfth aspect, the malfunction of the piezoelectric element consisting of thin films, which is caused by the moisture, is prevented.

A thirteenth aspect of the present invention is the ink-jet recording head according to any one of the first to eleventh aspects, wherein the passage-forming substrate is formed of ceramics, and the respective layers of the piezoelectric element are formed by either pasting of green sheets or printing.

In the thirteenth aspect, even the piezoelectric element formed by pasting of the green sheet and the like can be securely prevented from the malfunction caused by the moisture.

A fourteenth aspect of the present invention is the ink-jet recording head according to any one of the first to eleventh aspects, wherein the piezoelectric element is a longitudinal vibration type piezoelectric element expanding and contracting in an axis direction, and the longitudinal vibration type piezoelectric element having piezoelectric materials and electrode forming materials alternately stacked.

In the fourteenth aspect, even in the case of using the longitudinal vibration type piezoelectric element, the malfunction of the piezoelectric element, which is caused by the moisture, is securely prevented.

A fifteenth aspect of the present invention is an ink-jet recording apparatus comprising the ink-jet recording head according to any one of the first to fourteenth aspects.

In the fifteenth aspect, an ink-jet recording apparatus can be realized, in which printing quality and reliability are improved.

A sixteenth aspect of the present invention is an ink-jet recording apparatus including an ink-jet recording head having a passage-forming substrate with a pressure generating chamber communicating with a nozzle orifice defined therein, a piezoelectric element provided on a region of the passage-forming substrate via a vibration plate, the region corresponding to the pressure generating chamber, and a sealing member defining a piezoelectric element holding portion securing a space not to hinder a movement of the piezoelectric element, the sealing member being joined onto a side of the piezoelectric element of the passage-forming substrate, the ink-jet recording apparatus comprising: at least one sealed portion as a space provided in a member other than the sealing member, communicating with the piezoelectric element holding portion and shielded from outside air.

In the sixteenth aspect, since the volume of the space sealing the piezoelectric element is made substantially large, the permissible level for the variation factor during the manufacturing process is increased, so that the manufacturing process can be simplified and the yield is improved.

A seventeenth aspect of the present invention is the ink-jet recording apparatus according to the sixteenth aspect, wherein the sealed portion is for preventing an increase in humidity in the piezoelectric element holding portion.

In the seventeenth aspect, the destruction of the piezoelectric element, which is caused by the moisture, can be prevented for a long period of time.

An eighteenth aspect of the present invention is the ink-jet recording apparatus according to any one of the sixteenth and seventeenth aspects, wherein humidity absorbent is provided in the sealed portion.

In the eighteenth aspect, the inside of the piezoelectric element holding portion is maintained at low humidity by the humidity absorbent, and the malfunction of the piezoelectric element, which is caused by the moisture and the like in the atmosphere, is prevented.

A nineteenth aspect of the present invention is the ink-jet recording apparatus according to the eighteenth aspect, wherein the humidity absorbent is exchangeable.

In the nineteenth aspect, the humidity absorbent is exchanged at specified timing, thus the inside of the piezoelectric element holding portion can be always maintained at low humidity.

A twentieth aspect of the present invention is the ink-jet recording apparatus according to any one of the sixteenth to nineteenth aspects, wherein a dry fluid is filled in the sealed portion.

In the twentieth aspect, the inside of the piezoelectric element holding portion is maintained securely at low humidity, and the malfunction of the piezoelectric element, which is caused by moisture, is prevented.

A twenty-first aspect of the present invention is the ink-jet recording apparatus according to the twentieth aspect, wherein the dry fluid is an inert fluid.

In the twenty-first aspect, since the piezoelectric element is held in the inert fluid, the malfunction of the piezoelectric element, which is caused by the change of the external environment is prevented.

A twenty-second aspect of the present invention is the ink-jet recording apparatus according to any one of the sixteenth to twenty-first aspects, wherein pressure in the piezoelectric element holding portion are set equal to the atmospheric pressure or higher.

In the twenty-second aspect, the pressure in the piezoelectric element holding portion is always made larger than the atmospheric pressure, and the moisture can be prevented from invading the inside of the piezoelectric element holding portion from the adhesive layer or the like joining the passage-forming substrate and the sealing member to each other.

A twenty-third aspect of the present invention is the ink-jet recording apparatus according to the twenty-second aspect, wherein pressure adjusting means for adjusting the pressure in the sealed portion to be approximately equal to the atmospheric pressure is provided in a wall defining the sealed portion.

In the twenty-third aspect, since the pressure in the piezoelectric element holding portion is always made approximately equal to the atmospheric pressure, the stress does not occur in the vibration plate even if the atmospheric pressure is changed, and the ink ejection characteristic can always be well maintained.

A twenty-fourth aspect of the present invention is the ink-jet recording apparatus according to the twenty-second aspect, wherein the dry fluid is compressed and filled in the sealed portion.

In the twenty-fourth aspect, the pressure in the piezoelectric element holding portion is always made larger than the atmospheric pressure, and moisture can be prevented from invading the inside of the piezoelectric element holding portion from the adhesive layer or the like joining the passage-forming substrate and the sealing member to each other.

A twenty-fifth aspect of the present invention is the ink-jet recording apparatus according to the twenty-fourth aspect, wherein the dry fluid is supplied from the sealed portion into the piezoelectric element holding portion to maintain the pressure in the piezoelectric element holding portion approximately constant.

In the twenty-fifth aspect, the pressure in the piezoelectric element holding portion is maintained approximately constant for a long period of time.

A twenty-sixth aspect of the present invention is the ink-jet recording apparatus according to any one of the twenty-fourth and twenty-fifth aspects, further comprising: pressure detecting means for detecting the pressure in the sealed portion; and informing means for informing a user of specified information in a case where a detection result of the pressure detecting means does not satisfy a specified condition.

In the twenty-sixth aspect, since the informing means informs the user of specified information from the detection result obtained by detection of the pressure detecting means, the user can readily determine a state in the sealed portion, for example, a residual amount of the dry fluid.

A twenty-seventh aspect of the present invention is the ink-jet recording apparatus according to any one of the sixteenth to twenty-sixth aspects, further comprising: ink supplying means for supplying ink to the ink-jet recording head, the ink supplying means being detachably held thereon, wherein the sealed portion and the ink supplying means are formed integrally.

In the twenty-seventh aspect, since the sealed portion is exchanged together with the ink cartridge, it is possible to always maintain the inside of the piezoelectric element holding portion at low humidity.

As described above, in the present invention, the piezoelectric element is sealed in each piezoelectric element holding portion, and at least one sealed portion as a space communicating with the piezoelectric element holding portion and being shielded from the outside air is provided, therefore, the piezoelectric element can be sealed in a low humidity atmosphere relatively readily, and the destruction of the piezoelectric element can be prevented.

DESCRIPTION OF THE PREFERRED EMBODIMENTS

Hereinafter, the present invention will be described in detail based on embodiments.

(Embodiment 1)

Figure 1:
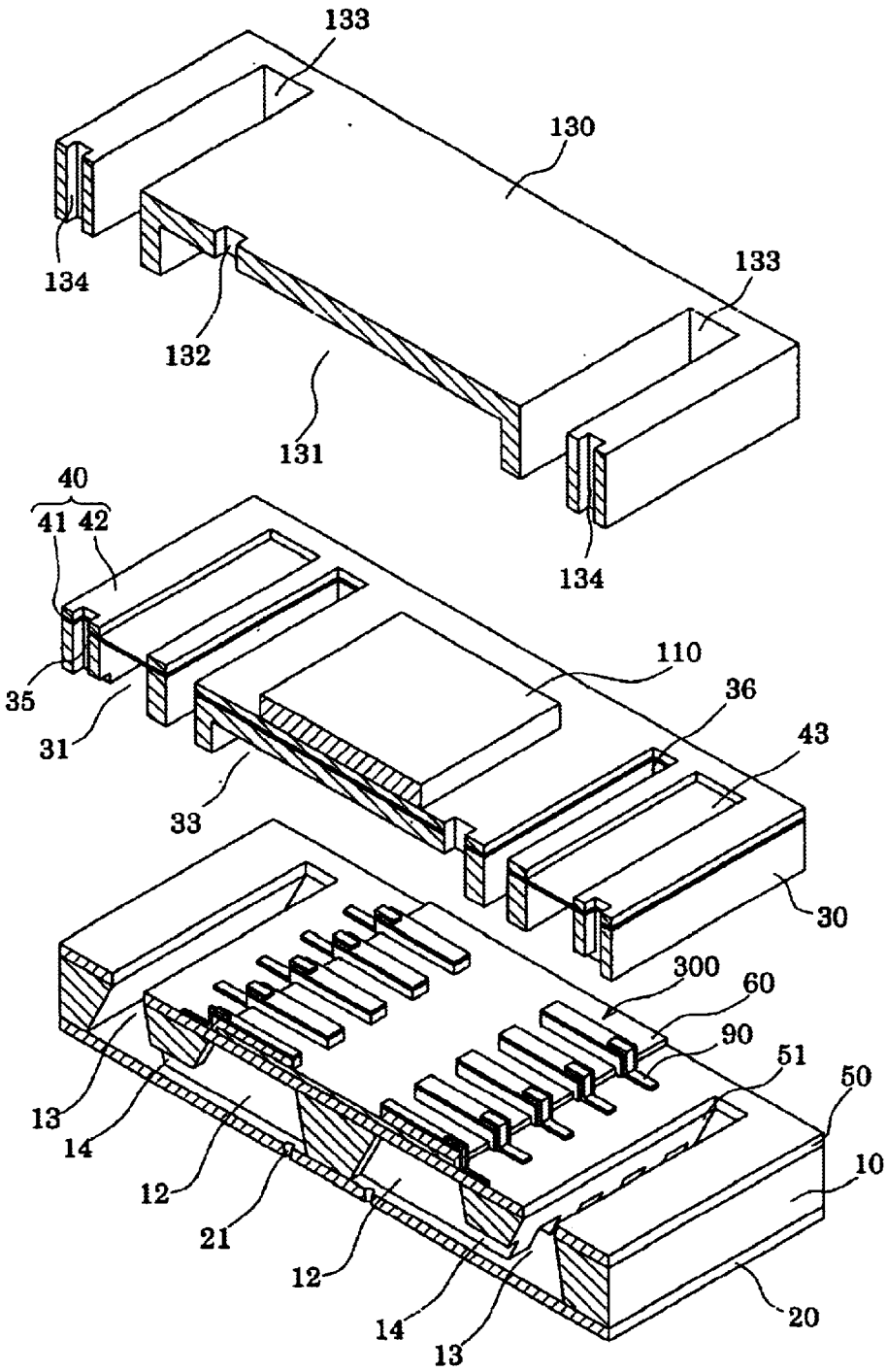
FIG. 1 is a perspective view schematically showing an ink-jet recording head according to embodiment 1 of the present invention.
Figure 2:
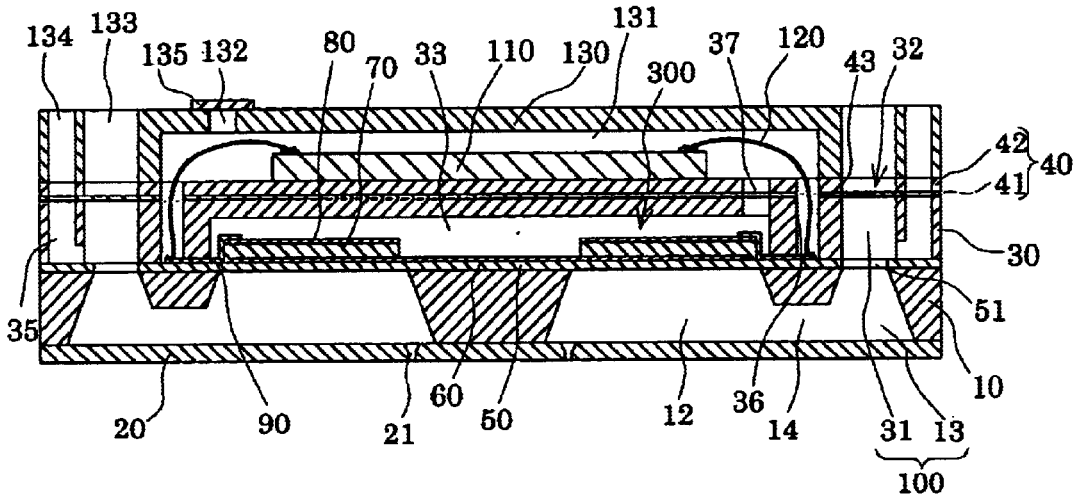
FIG. 2 is a cross-sectional view of the ink-jet recording head according to embodiment 1 of the present invention.

FIG. 1 is an exploded perspective view showing an ink-jet recording head according to embodiment 1 of the present invention, and FIG. 2 is a cross-sectional view of FIG. 1.

As illustrated, a passage-forming substrate 10 consists of a single crystal silicon substrate of a plane orientation (110)

in this embodiment, and on one surface thereof, an elastic film 50 having a thickness ranging from 1 to 2 μm is formed, which consists of silicon dioxide previously formed by thermal oxidation.

In this passage-forming substrate 10, pressure generating chambers 12 partitioned by a plurality of compartment walls are formed by carrying out anisotropic etching from the other surface than the surface having the elastic film 50 formed thereon. Moreover, outside the longitudinal direction of the pressure generating chambers 12 of the respective rows, is formed a communicating portion 13 communicating via a communicating hole 51 with a reservoir portion 31 provided in a reservoir forming plate 30 to be described later and constituting a reservoir 100 that will be a common ink chamber to the respective pressure generating chambers 12. Furthermore, this communicating portion 13 is made to communicate in the longitudinal direction via an ink supply passage 14 with the end of the pressure generating chambers 12, respectively.

Here, the anisotropic etching is carried out by utilizing a difference in etching rates of the single crystal silicon substrate. For example, in this embodiment, the anisotropic etching is carried out by utilizing a property of the following single crystal silicon substrate. Specifically, when the single crystal silicon substrate is immersed in an alkali solution such as KOH, it is gradually eroded, there emerge a first (111) plane perpendicular to a (110) plane and a second (111) plane forming an angle of about 70 degrees to the first (111) plane and an angle of about 35 degrees to the above-described (110) plane, and as compared with an etching rate of the (110) plane, an etching rate of the (111) plane is about 1/180. With such anisotropic etching, it is possible to perform high-precision processing based on depth processing in a parallelogram shape formed of two of the first (111) planes and two of the second (111) planes slant thereto, so that the pressure generating chambers 12 can be arranged in a high density.

In this embodiment, long sides of the respective pressure generating chambers 12 are formed of the first (111) planes, and short sides thereof are formed of the second (111) planes. These pressure generating chamber 12 are formed by etching the passage-forming substrate 10 until an etching depth almost penetrates through the passage-forming substrate 10 to reach the elastic film 50. Here, the elastic film 50 is eroded very little by the alkali solution used for etching the single crystal silicon substrate. Moreover, the respective ink supply passages 14 communicating with one end of the pressure generating chambers 12 are formed to be shallower than the pressure generating chambers 12, so that passage resistance of ink flowing into the pressure generating chambers 12 is maintained constant. Specifically, the ink supply passages 14 are formed by etching the single crystal silicon substrate partway in the thickness direction (half-etching). Note that the half-etching is carried out by adjusting the etching time.

With regard to a thickness of the passage-forming substrate 10, it is sufficient if the optimal thickness is selected in accordance with an array density of the pressure generating chambers 12. For example, if the array density of the pressure generating chambers 12 is about 180 pieces per inch (180 dpi), then the thickness of the passage-forming substrate 10 may be satisfactorily about 220 μm. However, for example when the array density is relatively high as 200 dpi or higher, it is preferable that the thickness of the passage-forming substrate 10 be set relatively thin as 100 μm or thinner. This is because the array density can be increased while rigidity of each compartment wall between the pressure generating chambers 12 adjacent to each other being maintained.

On the opening surface side of the passage-forming substrate 10, a nozzle plate 20 having nozzle orifices 21 drilled therein is fixedly adhered via an adhesive or a thermowelding film, each nozzle orifice 21 communicating with the pressure generating chamber 12 at a spot opposite to the ink supply passage 14. Note that the nozzle plate 20 consists of glass ceramics, stainless steel or the like having a thickness of, for example, 0.1 to 1 mm and a linear expansion coefficient of, for example, 2.5 to 4.5 [$\times 10^{-6}$/° C.] at a temperature of 300° C. or lower. With one surface, the nozzle plate 20 wholly covers one surface of the passage-forming substrate 10 and plays a role of a reinforcement plate for protecting the single crystal silicon substrate from a shock or an external force. Moreover, the nozzle plate 20 may be formed of a material having a thermal expansion coefficient approximately equal to that of the passage-forming substrate 10. In this case, since deformations of the passage-forming substrate 10 and the nozzle plate 20 due to heat become approximately the same, the passage-forming substrate 10 and the nozzle plate 20 can be joined readily to each other by use of a thermosetting adhesive and the like.

Note that a size of the nozzle orifices 21 drilled in the nozzle plate 20 and a size of the pressure generating chambers 12 are optimized in accordance with an amount of ejected ink droplets, an ejection speed, an ejection frequency thereof and the like. For example, in a case where 360 ink droplets per one inch are recorded, it is necessary that the nozzle orifices 21 be formed with a diameter of several ten micrometers with good accuracy.

Meanwhile, on the elastic film 50 provided on the passage-forming substrate 10, a lower electrode film 60 having a thickness of, for example, about 0.2 μm, a piezoelectric layer 70 having a thickness approximately ranging, for example, from 0.5 to 3.0 μm and an upper electrode film 80 having a thickness of, for example, about 0.1 μm are formed in a stacked state in a process (to be described later), thus constituting a piezoelectric element 300. Here, the piezoelectric element 300 means a portion including the lower electrode film 60, the piezoelectric layer 70 and the upper electrode film 80. In general, the piezoelectric element 300 is constituted such that any one of electrodes of the piezoelectric element 300 is made to be a common electrode, and that the other electrode and the piezoelectric layer 70 are patterned for each pressure generating chamber 12. Here, a portion, which is constituted of the patterned one of electrodes and the patterned piezoelectric layer 70, and where a piezoelectric distortion is generated by application of a voltage to both of the electrodes, is referred to as a piezoelectric active portion. In this embodiment, the lower electrode film 60 is made to be a common electrode of the piezoelectric element 300, and the upper electrode film 80 is made to be an individual electrode of the piezoelectric element 300. However, no impediment occurs even if the above-described order is reversed in order to appropriately position a drive circuit or wiring. In any case, the piezoelectric active portion will be formed for each pressure generating chamber. In addition, here, a combination of the piezoelectric element 300 and a vibration plate in which displacement occurs due to the drive of the piezoelectric element 300 is referred to as a piezoelectric actuator. Note that, though the elastic film 50 and the lower electrode film 60 function as the vibration plate in this embodiment, the lower electrode film 60 may also serve as the elastic film 50.

Moreover, to the surface of the passage-forming substrate 10, which has the piezoelectric element 300 formed thereon, is joined the reservoir forming plate 30 having the reservoir portion 31 constituting at least a part of the reservoir 100. In this embodiment, The reservoir portion 31 is formed so as to penetrate the reservoir forming plate 30 in the thickness direction, and across the direction where the pressure generating chambers 12 are provided parallel to each other.

Then, the reservoir portion 31 is made to communicate with the communicating portion 13 of the passage-forming substrate 10 via the communicating hole 51 provided by penetrating the elastic film 50 and the lower electrode film 60. The reservoir portion 31 and the communicating portion 13 constitute the reservoir 100 that will be the common ink chamber of the respective pressure generating chambers 12.

For this reservoir forming plate 30, it is preferable to use a material such as, for example, glass and ceramics, which has a thermal expansion coefficient approximately equal to that of the passage-forming substrate 10. In this embodiment, the reservoir forming plate 30 is formed of the single crystal silicon substrate, which is the same material as that of the passage-forming substrate 10. Thus, similarly to the above-described case of the nozzle plate 20, the reservoir forming plate 30 and the passage-forming substrate 10 can be adhered securely even if adhesion is carried out at a high temperature by use of the thermosetting adhesive. Hence, the manufacturing process can be simplified.

Moreover, onto this reservoir forming plate 30, is joined a compliance plate 40 consisting of a sealing film 41 and a fixing plate 42. Here, the sealing film 41 consists of a less rigid and flexible material (for example, a polyphenylene sulfide (PPS) film having a thickness of 6 $\mu$m), and by this sealing film 41, one side surface of the reservoir portion 31 is sealed. Moreover, the fixing plate 42 is formed of a hard material such as metal (for example, such as stainless steel (SUS) having a thickness of 30 $\mu$m). A region of the fixing plate 42, which faces the reservoir 100, is completely removed in the thickness direction to become an opening portion 43. Therefore, one side surface of the reservoir 100 is sealed only by the flexible sealing film 41 to become a flexible portion 32 deformable by a change of internal pressure.

Moreover, in the compliance plate 40 and the reservoir forming plate 30, which are located outside of the approximate center in the longitudinal direction of the reservoir 100, an ink introducing passage 35 for supplying ink to the reservoir 100 is provided.

Furthermore, the reservoir forming plate 30 also serves as a sealing member sealing the piezoelectric element 300, in which a piezoelectric element holding portion 33 capable of hermetically sealing a space secured so as not to hinder a movement of the piezoelectric element 300 is provided in a region facing the piezoelectric element 300. Then, the piezoelectric element 300 is hermetically sealed in the piezoelectric element holding portion 33, so that the destruction of the piezoelectric element 300 can be prevented, which is caused by an external environment such as moisture in the atmosphere.

Moreover, on the fixing plate 42, a drive circuit 110 such as a semiconductor integrated circuit (IC) or the like for driving the piezoelectric element 300 is mounted. Then, the drive circuit 110 is electrically connected to each lead electrode 90 by a drive wiring 120 consisting of a bonding wire or the like extended via a through hole 36 provided in a region between the reservoir portion 31 and the piezoelectric element holding portion 33 of the reservoir forming plate 30 and the compliance plate 40 (refer to FIG. 2).

Furthermore, a first sealing member 130 having a first sealed portion 131 as a space communicating with the piezoelectric element holding portion 33 and shielded from the outside air is joined onto the fixing plate 42, and the drive circuit 110 is hermetically sealed in the first sealed portion 131. Note that the first sealed portion 131 communicates with the piezoelectric element holding portion 33 via a through hole 37 provided by penetrating the reservoir forming plate 30 and the compliance plate 40.

Here, the first sealed portion 131 prevents an increase in humidity in the piezoelectric element holding portion 33. In the piezoelectric element holding portion 33 and the first sealed portion 131, a dry fluid is filled via an introducing port 132 provided in the first sealing member 130, and this introducing port 132 is hermetically sealed by an adhesive 135 or the like. Then, the dry fluid in the first sealing member 130 will be supplied into the piezoelectric element holding portion 33 via the through hole 37. Specifically, the inside of the piezoelectric element holding portion 33 is filled with the dry fluid by the first sealed portion 131, so that the increase in humidity is prevented, and the piezoelectric element 300 hermetically sealed in the piezoelectric element holding portion 33 is held in a dry fluid atmosphere to be prevented from the destruction caused by the moisture and the like in the atmosphere.

The dry fluid filled in the first sealed portion 131 is not particularly limited, and air from which humidity is removed or the like may be used. However for example, it may be preferable to use inert gas such as nitrogen, Moreover, it is preferable that a pressure in the first sealed portion 131 and the piezoelectric element holding portion 33 be an approximately constant pressure higher than the atmospheric pressure. For example, in this embodiment, the dry fluid is compressed and filled in the first sealed portion 131, whereby the pressure in the first sealed portion 131 and the piezoelectric element holding portion 33 is maintained to be a constant pressure higher than the atmospheric pressure.

Thus, the moisture can be prevented from invading the inside of the piezoelectric element holding portion 33, for example, from the adhesive or the like having adhered the passage-forming substrate 10 and the reservoir forming plate 30, so that the increase in humidity in the piezoelectric element holding portion 33 can be prevented more securely.

Moreover, in the first sealing member 130 in a region facing the flexible portion 32, a through hole 133 penetrating the same member 130 in the thickness direction is provided, and outside of the approximate center in the longitudinal direction of the through hole 133,a ink introducing port 134 communicating with the ink introducing passage 35 to supply ink to the reservoir 100 is provided.

As described above, in this embodiment, since the first sealed portion 131 communicating with the piezoelectric element holding portion 33 is provided, a volume of the space where the piezoelectric element 300 will be sealed is relatively large. Thus, a permissible level for a variation factor such as residual of adhesive solvent and moisture which are used in the manufacturing process is increased, and therefore, the manufacturing process can be simplified and the yield is improved. Moreover, as a volume of the piezoelectric element holding portion 33 can be reduced, assembly precision can be improved.

Furthermore, in this embodiment, since the drive circuit 110 is sealed in the first sealed portion 131, a necessity of molding the drive circuit 110 with resin or the like is eliminated, so that the manufacturing process can be simplified. Note that, as a matter of course, the drive circuit 110 may be provided not only in the first sealed portion 131, but for example, the drive circuit 110 may also be provided on the first sealed portion 130 and molded with resin or the like.

Figure 3:
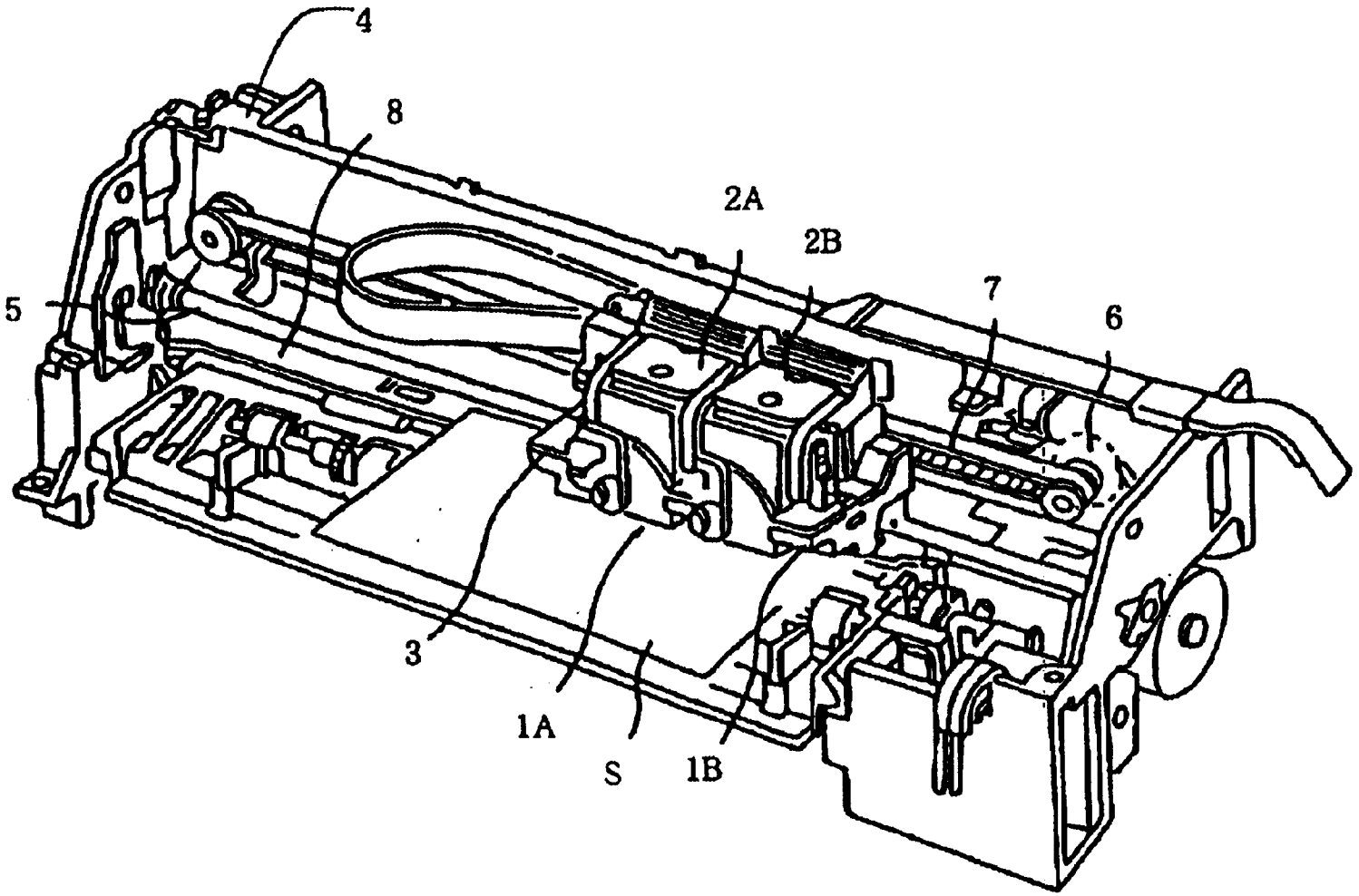
FIG. 3 is a schematic view of an ink-jet recording apparatus according to embodiment 1 of the present invention.

The ink-jet recording head as described above constitutes a part of a recording head unit including an ink passage communicating with an ink cartridge and the like, and is mounted on an ink-jet recording apparatus. FIG. 3 is a schematic view showing one example of the ink-jet recording apparatus.

As shown in FIG. 3, in recording head units 1A and 1B having the ink-jet recording heads, cartridges 2A and 2B constituting ink supplying means are detachably provided. A carriage 3 having these recording head units 1A and 1B mounted thereon is provided on a carriage shaft 5 attached to an apparatus body 4 so as to be freely movable in the shaft direction. These recording head units 1A and 1B, for example, are set to eject a black ink composition and a color ink composition, respectively.

Then, a driving force of a drive motor 6 is transmitted to the carriage 3 via a plurality of gears (not shown) and a timing belt 7, thus moving the carriage 3 mounting thereon the recording head units 1A and 1B along the carriage shaft 5. Meanwhile, a platen 8 is provided on the apparatus body 4 along the carriage 3. The platen 8 can be rotated by a driving force of a paper feed motor (not shown), and onto the platen 8, a recording sheet S as a recording medium such as paper fed by a paper feed roller (not shown) or the like is conveyed.

(Embodiment 2)

Figure 4:
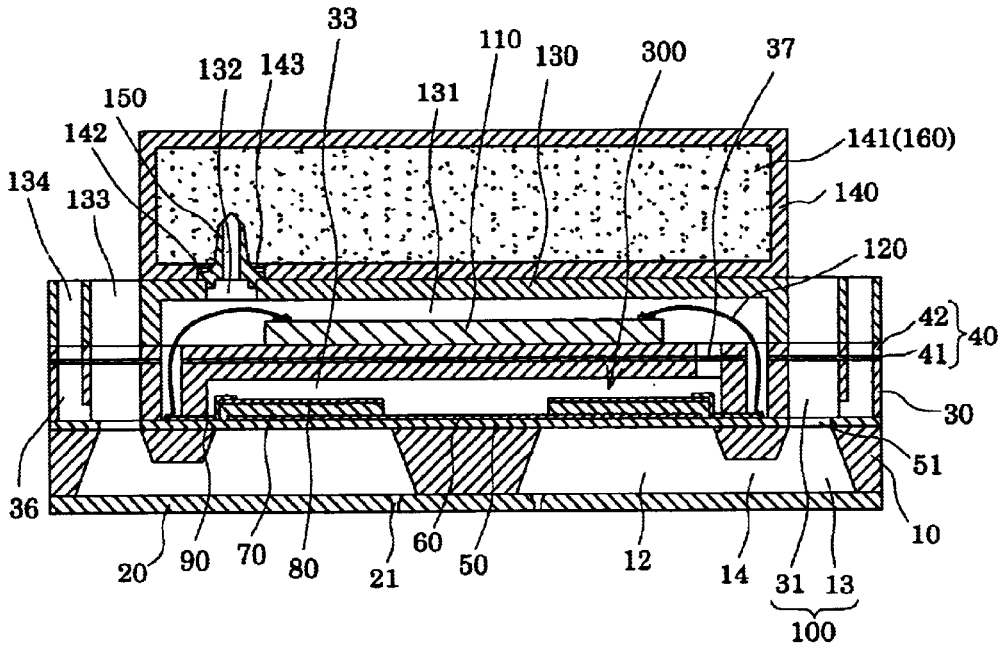
FIG. 4 is a cross-sectional view of an ink-jet recording head according to embodiment 2 of the present invention.

FIG. 4 is a cross-sectional view of an ink-jet recording head according to embodiment 2.

This embodiment is an example of providing a plurality of sealed portions as spaces, each communicating with the piezoelectric element holding portion 33 and being shielded from the outside air.

concretely, as shown in FIG. 4, a second sealing member 140 having a second sealed portion 141 is fixed onto the first sealing member 130 in this embodiment. Moreover, on a portion facing the introducing port 132 of the first sealing member 130, a needle-shaped member 150 is provided. This needle-shaped member 150 is inserted into an insertion port 142 provided in the second sealing member 140, thus allowing the first sealed portion 131 and the second sealed portion 141 to communicate with each other. Specifically, in this embodiment, the second sealing member 140 having the second sealed portion 141 is detachably fixed onto the first sealing member 130, and the needle-shaped member 150 is inserted into a sealing film 143 sealing the insertion port 142, thus allowing the first sealed portion 131 and the second sealed portion 141 to communicate with each other.

Moreover, in the second sealed portion 141, humidity absorbent 160 for absorbing the moisture in the piezoelectric element holding portion 33 and the first sealed portion 131 is provided to prevent an increase in humidity in the piezoelectric element holding portion 33 and the first sealed portion 131. Specifically, since the inside of the piezoelectric element holding portion 33 is always maintained at low humidity by the humidity absorbent 160, the destruction of the piezoelectric element 300 or the like, which is caused by moisture, can be prevented. Note that the type of such humidity absorbent is not particularly limited, but for example, silica gel, calcium carbonate and the like can be used.

As described above, in this embodiment, since the plurality of sealed portions communicating with the piezoelectric element holding portions 33 are provided, the volume of each space where the piezoelectric element 300 is sealed is made larger. Hence, as described above, the manufacturing process can be simplified and the yield is further improved. Moreover, since the humidity absorbent 160 is provided in the second sealed portion 141 to prevent an increase in humidity in the piezoelectric element holding portion 33, the destruction of the piezoelectric element 300, which is caused by moisture and the like, can be more securely prevented. Furthermore, since an installation area of the humidity absorbent can be made relatively large, the inside of the piezoelectric element holding portion 33 can be maintained at low humidity for a long period of time.

Note that pressure adjusting means for carrying out an adjustment so that pressures in the second sealed portion 141, the first sealed portion 131 and the piezoelectric element holding portion 33 can be approximately equal to the atmospheric pressure may be provided in a wall defining the second sealed portion 141 in which the humidity absorbent 160 is provided as described above. This pressure adjusting means is not particularly limited, but for example, a diaphragm valve opening/closing depending on a change of the atmospheric pressure and the like are included.

Thus, even if the atmospheric pressure is changed, the pressure in the piezoelectric element holding portion 33 can be always maintained constant, thus making it possible to suppress a stress change caused in the vibration plate by variation of the atmospheric pressure.

Moreover, in the case of using the diaphragm valve as pressure adjusting means, it is preferable to provide the diaphragm valve in the wall defining the second sealed portion 141 in which the humidity absorbent 160 is provided as described above. Thus, the air enters the inside of the piezoelectric element holding portion 33 via the humidity absorbent 160, thereby eliminating entrance of high humidity air into the piezoelectric element holding portion 33.

Moreover, in this embodiment, since the humidity absorbent 160 is provided in the second sealed portion 141 and the second sealing member 140 is detachably fixed, if the second sealing member 140 is exchanged at a specified timing, the inside of the piezoelectric element holding portion 33 can be always maintained at low humidity, thus making it possible to prevent the destruction of the piezoelectric element 300. As a matter of course, a constitution may be also adopted, in which the second sealed portion 141 is set capable of opening/closing to allow only the humidity absorbent 160 to be exchanged.

Furthermore, in this embodiment, the piezoelectric element holding portion 33 and the first sealed portion 131 are made to communicate with each other, and the first sealed portion 131 and the second sealed portion 141 are made to communicate with each other. However for example, the piezoelectric element holding portion 33 and the first sealed portion 131 are not made to communicate with each other, but the piezoelectric element holding portion 33 and the second sealed portion 141 may be made to directly communicate with each other. In any case, a space shielded from the outside air may satisfactorily communicate with the piezoelectric element holding portion.

(Embodiment 3)

Figure 5:
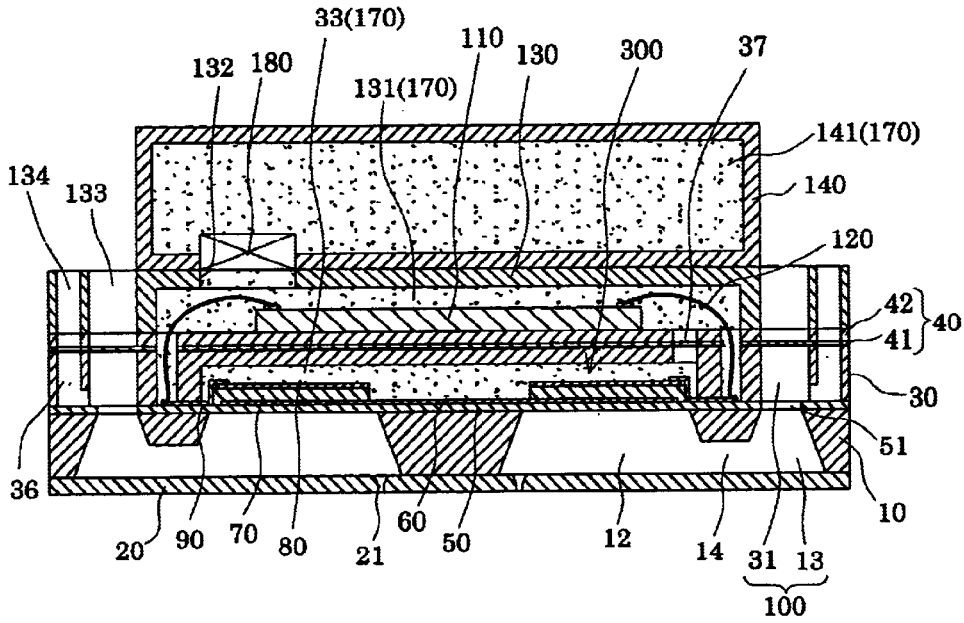
FIG. 5 is a cross-sectional view of an ink-jet recording head according to embodiment 3 of the present invention.

FIG. 5 is a cross-sectional view of an ink-jet recording head according to embodiment 3.

This embodiment is an example where a dry fluid is filled in the piezoelectric element holding portion, and an internal pressure thereof is maintained at an approximately constant pressure equal to the atmospheric pressure or higher, thus preventing the destruction of the piezoelectric element, which is caused by moisture.

Specifically, in this embodiment, as shown in FIG. 5, a dry fluid 170 is compressed and filled in the second sealed portion 141 of the second sealing member 140 detachably fixed onto the first sealing member 130, and for example, an air pressure adjusting valve 180 such as a diaphragm valve is provided in a portion of the through hole 132 allowing the second sealed portion 141 and the first sealed portion 131 to communicate with each other.

In such a constitution, the dry fluid 170 in the second sealed portion 141 is supplied into the piezoelectric element holding portion 33, where the dry fluid 170 is always filled accordingly. Then, the air pressure adjusting valve 180 opens/closes accompanied by a pressure change of the piezoelectric element holding portion 33, so that a flow amount of the dry fluid 170 supplied from the second sealed portion 141 into the piezoelectric element holding portion 33 is adjusted. Concretely, the flow amount of the dry fluid 170 flowing into the piezoelectric element holding portion 33 is adjusted so as to be increased accompanied by a lowering of the pressure in the piezoelectric element holding portion 33 and to be lowered accompanied by an increase thereof.

Thus, the inside of the piezoelectric element holding portion 33 is maintained in a state where the dry fluid 170 is filled at an approximately constant pressure, and the increase in humidity in the piezoelectric element holding portion 33 is prevented. Therefore, the destruction of the piezoelectric element 300, which is caused by the moisture, can be securely prevented, Moreover, since a supply amount of the dry fluid 170 supplied to the piezoelectric element holding portion 33 is adjusted appropriately by the air pressure adjusting valve 180, the dry fluid 170 is supplied efficiently into the piezoelectric element holding portion 33, thus the destruction of the piezoelectric element 300 can be prevented for a long period of time.

Furthermore, if the second sealing member 140 is exchanged at a specified timing, then the inside of the piezoelectric element holding portion 33 can always be maintained at low humidity.

Note that the air pressure adjusting valve 180. opening/closing depending on the pressure change in the piezoelectric element holding portion 33 is used in this embodiment, but not being limited to this, for example, a constitution may be adopted, in which detecting means such as a pressure sensor for detecting an internal pressure is provided in the piezoelectric element holding portion 33, and the air pressure adjusting valve is controlled based on a detection result of this detecting means to be opened/closed appropriately.

Moreover, in the case of mounting the ink-jet recording head as described above on the ink-jet recording apparatus, a user may be informed of exchange timing of the second sealing member 140.

Figure 6:
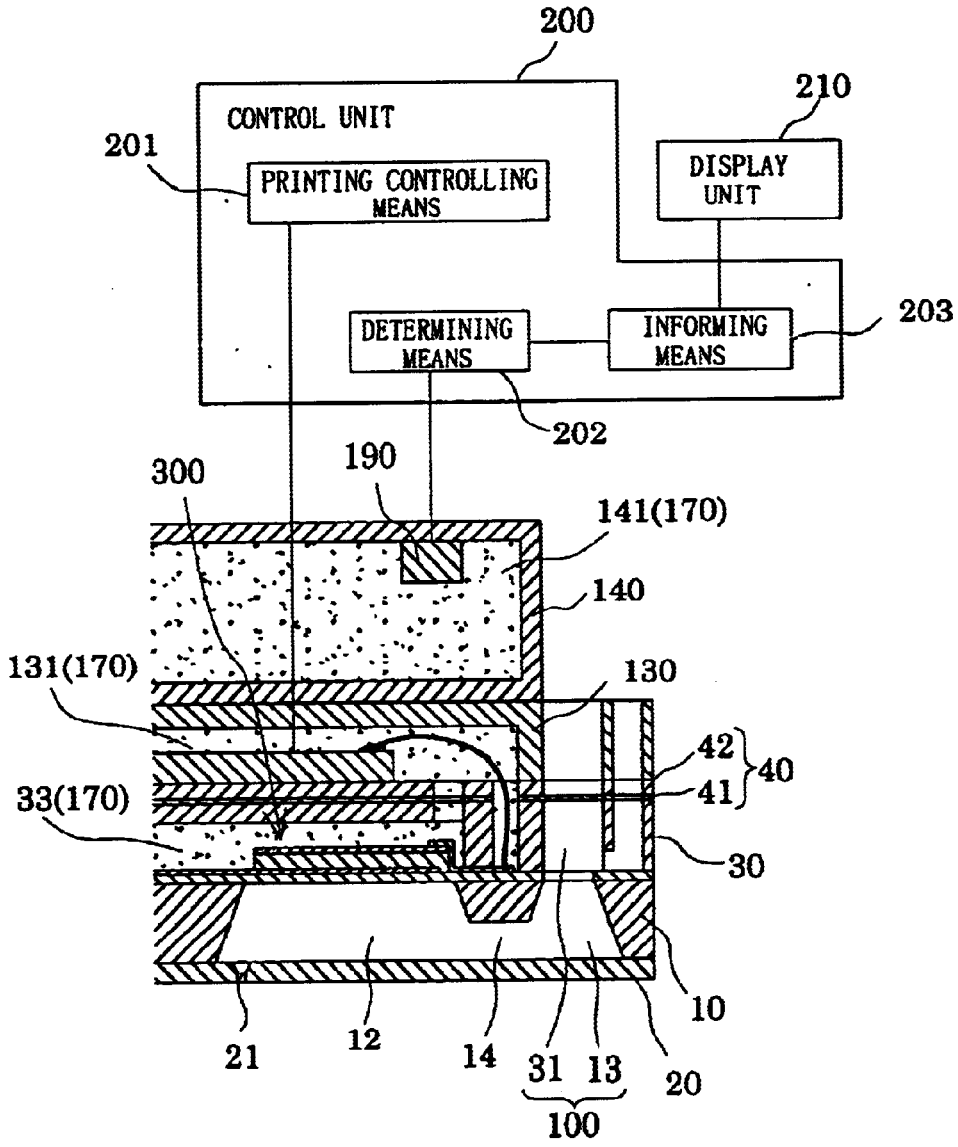
FIG. 6 is a schematic view explaining an ink-jet recording apparatus according to embodiment 3 of the present invention.

For example, in this embodiment, as shown in FIG. 6, the second sealing member 140 is provided with pressure detecting means 190 such as a pressure sensor for detecting a pressure in the second sealed portion 141. Meanwhile, a control unit 200 for controlling a printing operation by the ink-jet recording head as described above includes printing controlling means 201 for performing a variety of controls for the drive of the piezoelectric element 300 and the like for printing execution, determining means 202 for determining whether or not a detection result of the pressure detecting means 190 satisfies a specified condition, and informing means 203 for generating specified information and informing a user of necessary information via a display unit 210 such as, for example, a liquid crystal panel in the case where the determining means 202 determines that the specified condition is not satisfied.

Then, in the ink-jet recording apparatus as described above, in the case where the pressure detecting means 190 detects the pressure in the second sealed portion 141, and the determining means 202 determines that the pressure in the second sealed portion 141 does not reach a specified value based on the detection result of the pressure detecting means 190, that is, a residual amount of the dry fluid 170 in the second sealed portion 141 is reduced, the informing means 203 issues information requesting the exchange of the second sealing member 140 to the display unit 210 such as, for example, a display panel.

As described above, if a user is informed of the exchange timing of the second sealing member 140, then the second sealing member 140 is not wastefully exchanged, and the inside of the piezoelectric element holding portion 33 is always filled with the dry fluid 170 to be maintained at low humidity.

(Other Embodiment)

Although description has been made as above for the respective embodiments of the present invention, as a matter of course, the present invention is not limited to the above-described embodiments.

For example, in the above-described embodiments, the first sealing member and the second sealing member are provided in the ink-jet recording head, but not being limited to this, for example, may be provided in the ink-jet recording apparatus. Thus, the first and second sealing members themselves can be made significantly large, and volumes of the first and second sealed members can be made larger. Hence, the installation area of the humidity absorbent can be made large, and the exchange thereof is facilitated. Moreover, the filling amount of the dry fluid can be increased, so that the inside of the piezoelectric element holding portion can be maintained at low humidity for a long period of time. Moreover, for example if the communicating portion communicating with the piezoelectric element holding portion is formed integrally with the ink cartridge as ink supplying means for supplying ink to the pressure generating chamber, then the sealed portion (the communicating portion) can be exchanged readily at the same time when the ink cartridge is exchanged, thus the inside of the piezoelectric element holding portion can always be maintained at low humidity.

Moreover, for example, in the above-described embodiments, the thin film type ink-jet recording head manufactured by applying deposition and lithography processes is taken as an example. However, as a matter of course, the present invention is not limited to this, and for example, the present invention can be adopted for a thick film type ink-jet recording head formed by a method in which a green sheet is pasted, or the like.

Furthermore, though description has been made for the ink-jet recording head having the flexural displacement type piezoelectric element in the above-described embodiments, the present invention can be applied to an ink-set recording head, for example, having a longitudinal vibration type piezoelectric element structured such that piezoelectric materials and electrode forming materials are alternately sandwiched to be stacked.

Here, description will be made for one example of the ink-jet recording head having this longitudinal vibration type piezoelectric element with reference to FIG. 7 and FIG. 8.

Figure 7:
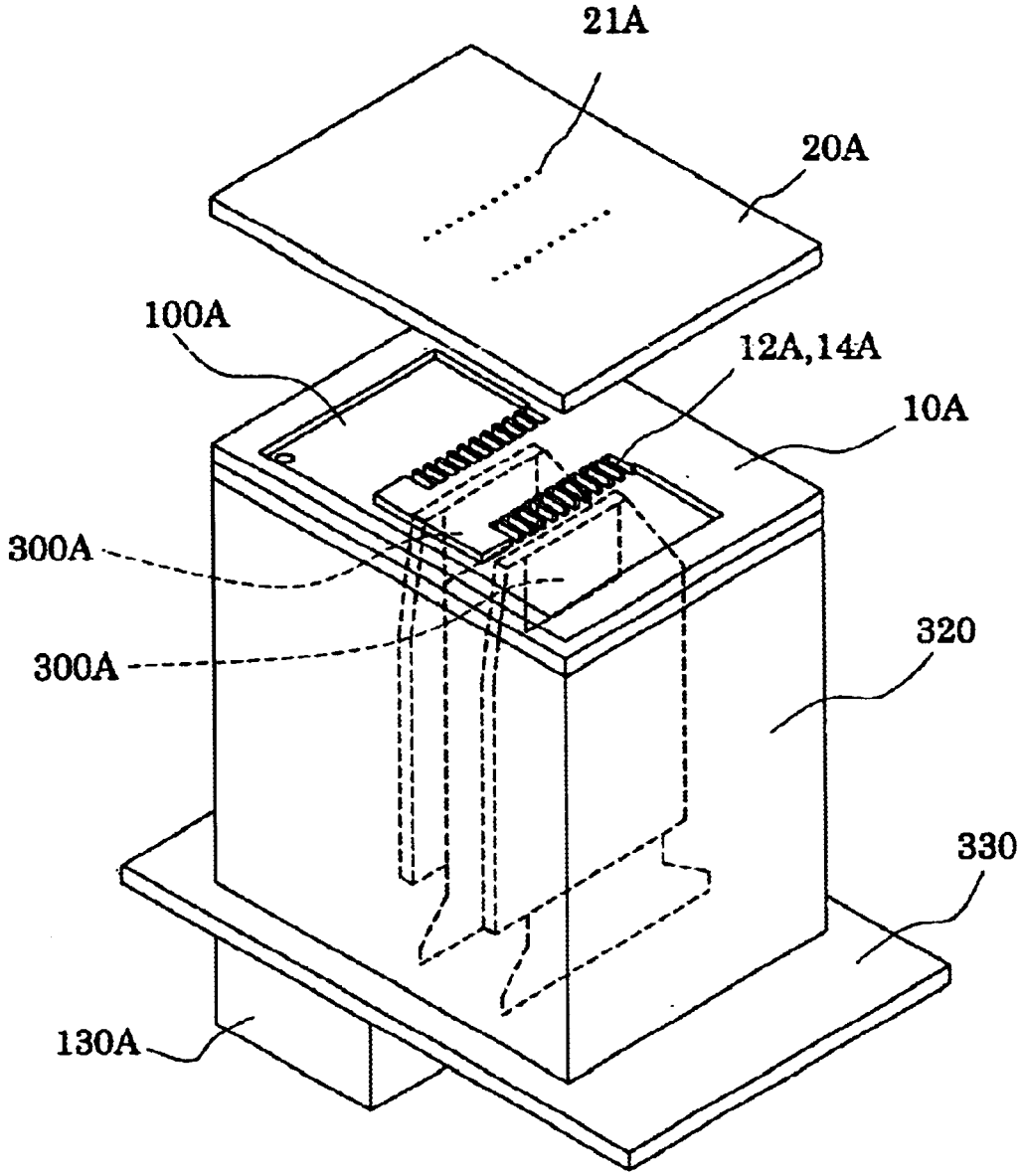
FIG. 7 is a perspective view schematically showing an ink-jet recording head according to the other embodiment of the present invention.
Figure 8:
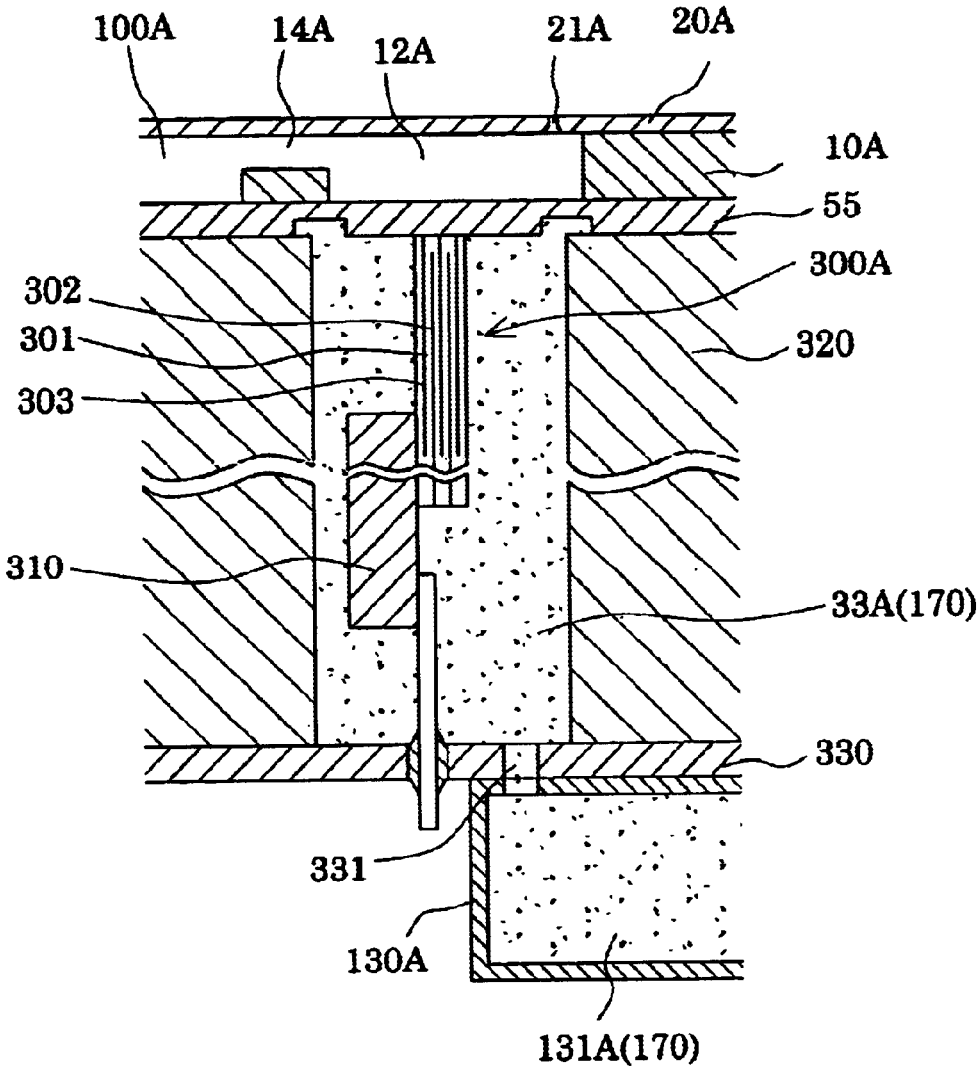
FIG. 8 is a cross-sectional view of the ink-jet recording head according to the other embodiment of the present invention.

The ink-jet recording head shown in FIG. 7 and FIG. 8 is of a type having longitudinal vibration type piezoelectric elements 300A. In a passage-forming substrate 10A, a reservoir 100 is formed together with a plurality of pressure generating chambers 12A, and both of them are made to communicate via ink supply passages 14A. Then, one side surface of the passage-forming substrate 10A is sealed by a nozzle plate 20A having nozzle orifices 21A corresponding to the respective pressure generating chambers 12A, and the other side surface thereof is sealed by a vibration plate 55.

Moreover, against a surface of the vibration plate 55, which is opposite a surface facing the pressure generating chambers 12A, a tip of the piezoelectric element 300A is made to abut regions corresponding to the respective pressure generating chambers 12A. In each piezoelectric element 300A, piezoelectric materials 301 and electrode forming materials 302 and 303 are sandwiched longitudinally and alternately to be stacked, and an inert region not contributing to vibration is fixedly adhered onto a fixing plate 310.

Moreover, on this vibration plate 55, is fixed a head frame 320 having a piezoelectric element holding portion 33A capable of hermetically sealing a space secured so as not to hinder a movement of the piezoelectric element 300A. This piezoelectric element holding portion 33A is sealed by a sealing plate 330 joined to the head frame 320.

Then, in this embodiment, a first sealing member 130A having a first sealed portion 131A is joined onto the sealing plate 330, the piezoelectric element holding portion 33A and the first sealed portion 131A are made to communicate with each other via a through hole 331 provided in the sealing plate 330, and the dry fluid 170 is filled in the piezoelectric element holding portion 33A and the first sealed portion 131A.

As a matter of course, even in the ink-jet recording head having the longitudinal vibration type piezoelectric element as described above, similarly to the above-described embodiments, the inside of the piezoelectric element holding portion 33A can be maintained at low humidity, and an increase in humidity can be prevented. Hence, the destruction of the piezoelectric element, which is caused by moisture, can be prevented for a long period of time.

Note that, in the ink-jet recording head thus constituted, ink is supplied to the reservoir 100A via an ink passage made to communicate with an ink cartridge, and is distributed to the respective pressure generating chambers 12A via the ink supply passages 14A. Actually, the piezoelectric element 300A is contracted by applying a voltage thereto. Thus, the vibration plate 55 is deformed (pulled downward in the drawing) together with the piezoelectric element 300A to expand a volume of the pressure generating chamber 12, so that ink is drawn into the pressure generating chamber 12A. Then, the inside of the pressure generating chamber 12A is filled with ink to reach the nozzle orifice 21A, followed by a release of the voltage applied to the electrode forming materials 302 and 303 of the piezoelectric element 300A in accordance with a recording signal from a drive circuit (not shown). Then, the piezoelectric element 300A is extended to return to an original state thereof. Thus, the vibration plate 55 is also displaced to return to an original state thereof, and therefore, the pressure generating chamber 12A is contracted, and the internal pressure is increased, and thus ink droplets are ejected from the nozzle orifice 21A.

As described above, the present invention can be applied to ink-jet recording heads of various structures without departing from the spirit thereof.

What is claimed is:

1. An ink-jet recording head including a passage-forming substrate having a pressure generating chamber communicating with a nozzle orifice defined therein and a piezoelectric element provided on a region of said passage-forming substrate via a vibration plate, said region corresponding to said pressure generating chamber, comprising:

a sealing member defining a piezoelectric element holding portion securing a space not to hinder a movement of said piezoelectric element, said sealing member being joined onto a side of said piezoelectric element of said passage-forming substrate; and at least one sealed portion as a space provided in a member other than said sealing member, communicating with said piezoelectric element holding portion and shielded from outside air.

2. The ink-jet recording head according to claim 1, wherein an increase in humidity of said piezoelectric element holding portion is prevented by said sealed portion.

3. The ink-jet recording head according to claim 1, wherein humidity absorbent is provided in said sealed portion.

4. The ink-jet recording head according to claim 3, wherein said humidity absorbent is exchangeable.

5. The ink-jet recording head according to claim 1, wherein a dry fluid is filled in said sealed portion.

6. The ink-jet recording head according to claim 5, wherein said dry fluid is an inert fluid.

7. The ink-jet recording head according to claim 1, wherein pressures in said piezoelectric element holding portion and said sealed portion are set equal to the atmospheric pressure or higher.

8. The ink-jet recording head according to claim 7, wherein pressure adjusting means for adjusting the pressure in said sealed portion to be approximately equal to the atmospheric pressure is provided in a wall defining said sealed portion.

9. The ink-jet recording head according to claim 7, wherein said dry fluid is compressed and filled in said sealed portion.

10. The ink-jet recording head according to claim 9, wherein said dry fluid is supplied from said sealed portion into said piezoelectric element holding portion to maintain the pressure in said piezoelectric element holding portion approximately constant.

11. The ink-jet recording head according to claim 1, wherein a drive circuit for driving said piezoelectric element is provided on said sealing member, and the drive circuit is sealed by said sealed portion.

12. The ink-jet recording head according to claim 1, wherein said passage-forming substrate consists of a single crystal silicon substrate, said pressure generating chamber is formed by anisotropic etching, and respective layers of said piezoelectric element are formed by deposition and lithography methods.

13. The ink-jet recording head according to claim 1, wherein said passage-forming substrate is formed of ceramics, and the respective layers of said piezoelectric element are formed by either pasting of green sheets or printing.

14. The ink-jet recording head according to claim 1, wherein said piezoelectric element is a longitudinal vibration type piezoelectric element expanding and contracting in an axis direction, and said longitudinal vibration type piezoelectric element having piezoelectric materials and electrode forming materials alternately stacked.

15. An ink-jet recording apparatus including an ink-jet recording head having a passage-forming substrate with pressure generating chamber communicating with a nozzle orifice defined therein, a piezoelectric element provided on a region of said passage-forming substrate via a vibration plate, said region corresponding to said pressure generating chamber, and a sealing member defining a piezoelectric element holding portion securing a space not to hinder a movement of said piezoelectric element, said sealing member being joined onto a side of said piezoelectric element of said passage-forming substrate, said ink-jet recording apparatus comprising:

at least one sealed portion as a space provided in a member other than said sealing member, communicating with said piezoelectric element holding portion and shielded from outside air.

16. The ink-jet recording apparatus according to claim 15, wherein said sealed portion is for preventing an increase in humidity of said piezoelectric element holding portion.

17. The ink-jet recording apparatus according to claim 15, wherein humidity absorbent is provided in said sealed portion.

18. The ink-jet recording apparatus according to claim 17, wherein said humidity absorbent is exchangeable.

19. The ink-jet recording apparatus according to claim 15, wherein a dry fluid is filled in said sealed portion.

20. The ink-jet recording apparatus according to claim 19, wherein said dry fluid is an inert fluid.

21. The ink-jet recording apparatus according to claim 15, wherein pressures in said piezoelectric element holding portion are set equal to the atmospheric pressure or higher.

22. The ink-jet recording apparatus according to claim 21, wherein pressure adjusting means for adjusting the pressure in said sealed portion to be approximately equal to the atmospheric pressure is provided in wall defining said sealed portion.

23. The ink-jet recording apparatus according to claim 21, wherein said dry fluid is compressed and filled in said sealed portion.

24. The ink-jet recording apparatus according to claim 23, wherein said dry fluid is supplied from said sealed portion into said piezoelectric element holding portion to maintain the pressure in said piezoelectric element holding portion approximately constant.

25. The ink-jet recording apparatus according to claim 23, further comprising: pressure detecting means for detecting the pressure in said sealed portion; and informing means for informing a user of specified information in a case where a detection result of the pressure detecting means does not satisfy a specified condition.

26. The ink-jet recording apparatus according to claim 15, further comprising: ink supplying means for supplying ink to said ink-jet recording head, said ink supplying means being detachably held thereon, wherein said sealed portion and said ink supplying means are formed integrally.

* * * * *